US011092028B2

(12) United States Patent
Haller et al.

(10) Patent No.: US 11,092,028 B2
(45) Date of Patent: Aug. 17, 2021

(54) TIP BALANCE SLITS FOR TURBINES

(71) Applicant: General Electric Company, Schenectady, NY (US)

(72) Inventors: Brian Robert Haller, Warwickshire (GB); Adrian Clifford Lord, Warwickshire (GB); Philip David Hemsley, Warwickshire (GB)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 111 days.

(21) Appl. No.: 16/483,098

(22) PCT Filed: Feb. 1, 2018

(86) PCT No.: PCT/US2018/016329
§ 371 (c)(1),
(2) Date: Aug. 2, 2019

(87) PCT Pub. No.: WO2018/144657
PCT Pub. Date: Aug. 9, 2018

(65) Prior Publication Data

US 2019/0353047 A1 Nov. 21, 2019

(30) Foreign Application Priority Data

Feb. 2, 2017 (EP) ..... 17154387

(51) Int. Cl.
*F01D 11/02* (2006.01)
*F01D 11/10* (2006.01)
(Continued)

(52) U.S. Cl.
CPC ..... *F01D 11/10* (2013.01); *F01D 1/04* (2013.01); *F01D 11/02* (2013.01); *F01D 11/08* (2013.01);
(Continued)

(58) Field of Classification Search
CPC ..... F01D 11/02; F01D 11/08; F01D 11/10; F05D 2220/31; F05D 2240/11; F05D 2260/606
See application file for complete search history.

(56) References Cited

U.S. PATENT DOCUMENTS 3,034,298 A 5/1962 White
3,597,102 A 8/1971 Unsworth et al.
(Continued)

FOREIGN PATENT DOCUMENTS

JP S53 13005 A 2/1978
WO 2012052740 A1 4/2012

OTHER PUBLICATIONS

International Search Report, PCT/US2018/016329, dated May 17, 2018 (3 pp.).
(Continued)

*Primary Examiner* — Ninh H. Nguyen
(74) *Attorney, Agent, or Firm* — Eversheds Sutherland (US) LLP

(57) ABSTRACT

This application provides controlled tip balance slits (200) for turbines. An example leakage flow control system (110) for a turbine may include a flow runner (150) with a tip shroud (152), a diaphragm or a guide blade (130), an extension ring (160) coupled to the diaphragm and positioned adjacent to the tip shroud (152), and a tip balance slit (200).

15 Claims, 6 Drawing Sheets

(51) Int. Cl.
*F01D 1/04* (2006.01)
*F01D 11/08* (2006.01)

(52) U.S. Cl.
CPC ..... *F05D 2210/12* (2013.01); *F05D 2220/31* (2013.01); *F05D 2240/11* (2013.01); *F05D 2260/606* (2013.01)

(56) References Cited

U.S. PATENT DOCUMENTS

| | | | | |
|---|---|---|---|---|
| 3,746,462 | A * | 7/1973 | Fukuda | F01D 11/10 415/115 |
| 4,146,352 | A * | 3/1979 | Yasugahira | F01D 5/145 415/144 |
| 5,328,326 | A * | 7/1994 | Gros | F01D 11/08 415/115 |
| 2005/0025617 | A1 | 2/2005 | Suzuki et al. | |
| 2009/0110550 | A1 | 4/2009 | Tani et al. | |
| 2010/0316488 | A1 | 12/2010 | Hofer | |
| 2011/0274536 | A1 | 11/2011 | Inomata et al. | |
| 2016/0115815 | A1* | 4/2016 | Homer | F01D 25/246 415/68 |
| 2016/0281518 | A1 | 9/2016 | Modachur Krishnan et al. | |

OTHER PUBLICATIONS

Extended Search Report, EP 17154387.9, dated Jul. 14, 2017 (10 pp.).

* cited by examiner

TIP BALANCE SLITS FOR TURBINES

TECHNICAL FIELD

The present application and the resultant patent relate generally to axial flow turbines of any type and more particularly relate to tip balance slits for steam turbines.

BACKGROUND OF THE INVENTION

Generally described, steam turbines and the like may have a defined steam path that includes a steam inlet, a turbine section, and a steam outlet. Steam leakage, either out of the steam path, or into the steam path from an area of higher pressure to an area of lower pressure, may adversely affect the operating efficiency of the steam turbine. For example, steam path leakage in the steam turbine between a rotating shaft and a circumferentially surrounding turbine casing may lower the overall efficiency of the steam turbine.

Steam may generally flow through a number of turbine stages typically disposed in series through first-stage guides and blades (or nozzles and buckets) and subsequently through guides and blades of later stages of the turbine. In this manner, the guides may direct the steam toward the respective blades, causing the blades to rotate and drive a load, such as an electrical generator and the like. The steam may be contained by circumferential shrouds surrounding the blades, which also may aid in directing the steam along the path. In this manner, the turbine guides, blades, and shrouds may be subjected to high temperatures resulting from the steam, which may result in the formation of hot spots and high thermal stresses in these components. Because the efficiency of a steam turbine is dependent on its operating temperatures, there is an ongoing demand for components positioned along the steam or hot gas path to be capable of withstanding increasingly higher temperatures without failure or decrease in useful life.

In some instances, leakage flow from a mainstream flow path of steam may flow through gaps between components of a turbine engine. Such leakage flow may reduce turbine efficiency and may causing mixing loss, disruption to mainstream flow, incidence onto a subsequent blade row, and/or other losses.

SUMMARY OF THE INVENTION

This application and the resultant patent provide leakage flow control systems for turbines. An example leakage flow control system may include a flow runner with a tip shroud, a diaphragm, an extension ring coupled to the diaphragm and positioned adjacent to the tip shroud, and a tip balance slit.

This application and the resultant patent further provide a method of controlling leakage flow in turbines. The method may include the steps of directing a tip leakage jet between a tip shroud and a first extension ring of a turbine, directing the tip leakage jet around a diaphragm, directing the tip leakage jet into a gap between a second extension ring, and directing the tip leakage jet through a tip balance slit formed in the second extension ring.

This application and the resultant patent further provide a steam turbine with a leakage flow control system. The steam turbine may include a first flow runner with a first tip shroud, a second flow runner with a second tip shroud, the second flow runner downstream of the first flow runner, a diaphragm, a flow path around at least a portion of the diaphragm from the first flow runner to the second flow runner, and a tip balance slit downstream of the flow path, the tip balance slit configured to introduce a tip leakage jet from the flow path to the mainstream flow near the second flow runner.

These and other features and improvements of this application and the resultant patent will become apparent to one of ordinary skill in the art upon review of the following detailed description when taken in conjunction with the several drawings and the appended claims.

DETAILED DESCRIPTION

Figure 1:
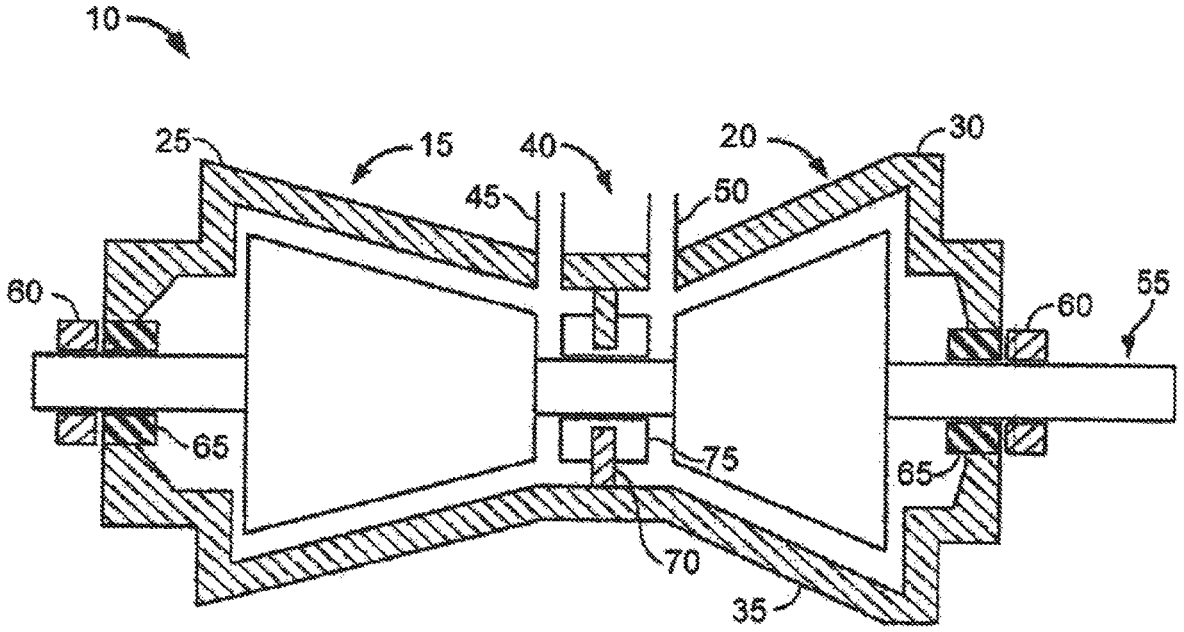
FIG. 1 is a schematic diagram of a steam turbine.

Referring now to the drawings, in which like numerals refer to like elements throughout the several views, FIG. 1 shows a schematic diagram of an example of a steam turbine 10. Generally described, the steam turbine 10 may include a high pressure section 15 and an intermediate pressure section 20. A rotor wheel may extend through the sections 15 and 20. Other pressures in other sections also may be used herein. An outer shell or casing 25 may be divided axially into an upper half section 30 and a lower half section 35. A central section 40 of the casing 25 may include a high pressure steam inlet 45 and an intermediate pressure steam inlet 50. Within the casing 25, the high pressure section 15 and the intermediate pressure section 20 may be arranged about a rotor or disc 55. The disc 55 may be supported by a number of bearings 60. A steam seal unit 65 may be located inboard of each of the bearings 60. An annular section divider 70 may extend radially inward from the central section 40 towards the disc. The divider 70 may include a number of packing casings 75. Other components and other configurations may be used.

During operation, the high pressure steam inlet 45 receives high pressure steam from a steam source. The steam may be routed through the high pressure section 15 such that work is extracted from the steam by rotation of the disc 55. The steam exits the high pressure section 15 and then may be returned to the steam source for reheating. The reheated steam then may be rerouted to the intermediate pressure section inlet 50. The steam may be returned to the intermediate pressure section 20 at a reduced pressure as compared to the steam entering the high pressure section 15 but at a temperature that is approximately equal to the temperature of the steam entering the high pressure section 15. Accordingly, an operating pressure within the high pressure section 15 may be higher than an operating pressure within the intermediary section 20 such that the steam within the high pressure section 15 tends to flow towards the intermediate section 20 through leakage paths that may develop between the high pressure 15 and the intermediate pressure section 20. One such leakage path may extend through the packing casing 75 about the disc shaft 55. Other leaks may develop across the steam seal unit 65 and elsewhere. While discussed in the context of certain embodiments, other embodiments of the disclosure may be used with other methods of turbine construction, such as Reaction Technology Blading (RTB) with drum rotor construction, or instances in which guides and seals may be directly mounted in a casing.

Figure 2:
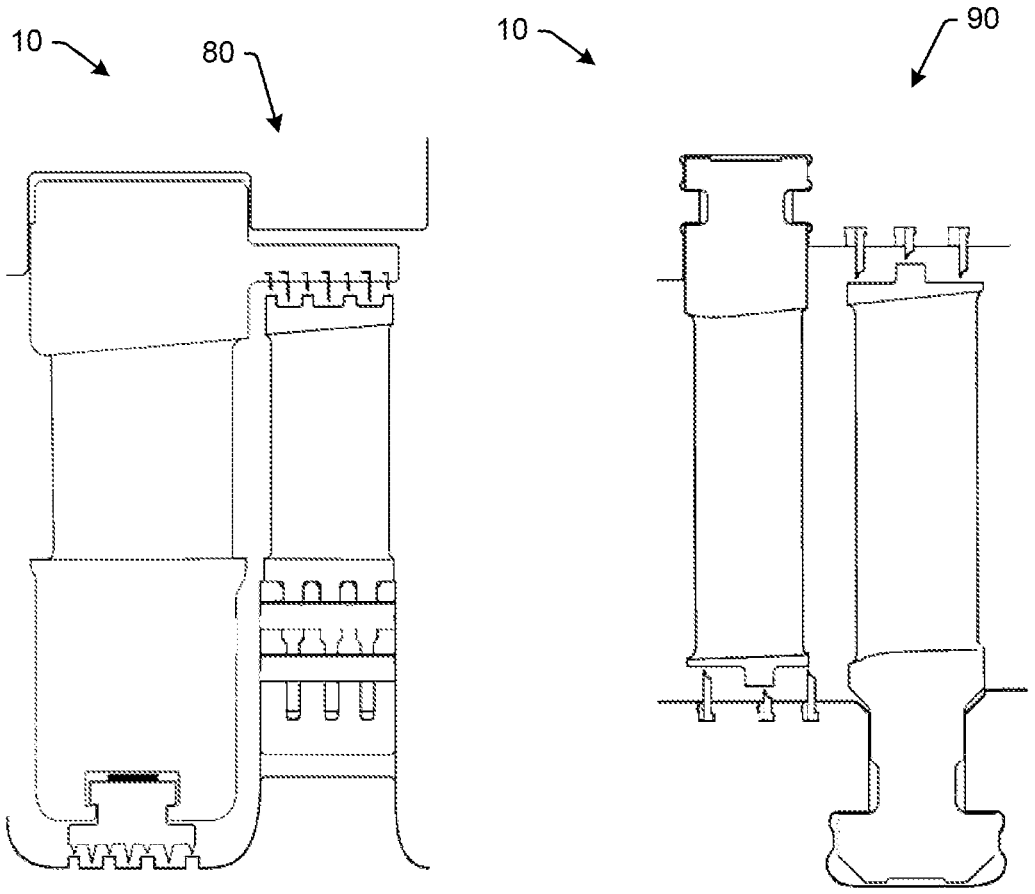
FIG. 2 is a schematic diagram of a portion of a turbine as may be used in the steam turbine of FIG. 1, showing various turbine constructions.

FIG. 2 shows a schematic diagram of various constructions of a portion of the steam turbine 10. The steam turbine 10 may have an impulse construction 80. Turbines with impulse construction may have a low root reaction and a disc and diaphragm construction. As illustrated, the impulse construction 80 may include a guide and a runner adjacent to each other. In other embodiments, the turbine 10 may have reaction technology blading 90. The reaction technology blading 90 may have a reaction drum construction and may include one or more dovetails with the runners. The dovetails may be used to secure the respective runners to the drum. Certain embodiments may be used with impulse and reaction technology blading. Other embodiments may have different configurations.

Figure 3:
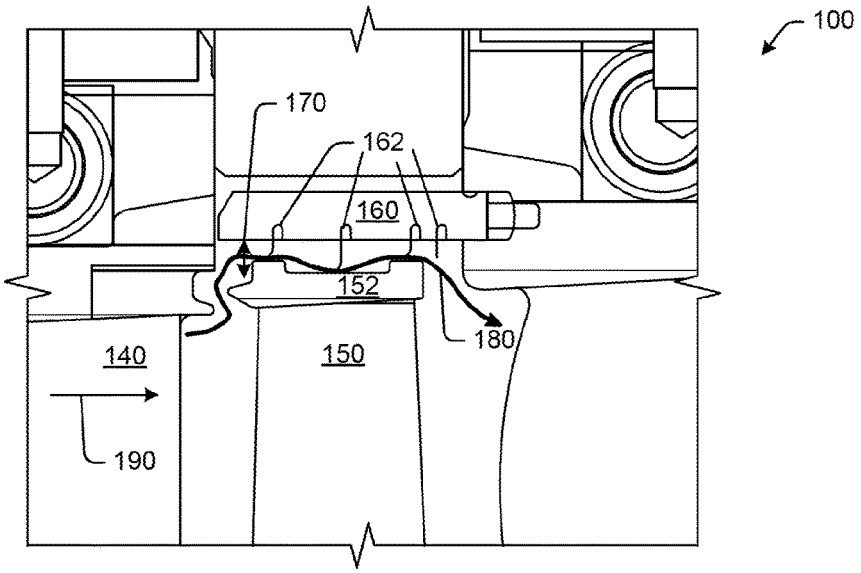
FIG. 3 is a schematic diagram of a portion of a turbine with a leakage flow control system with a tip balance slit as described herein in accordance with one or more embodiments.
Figure 3:
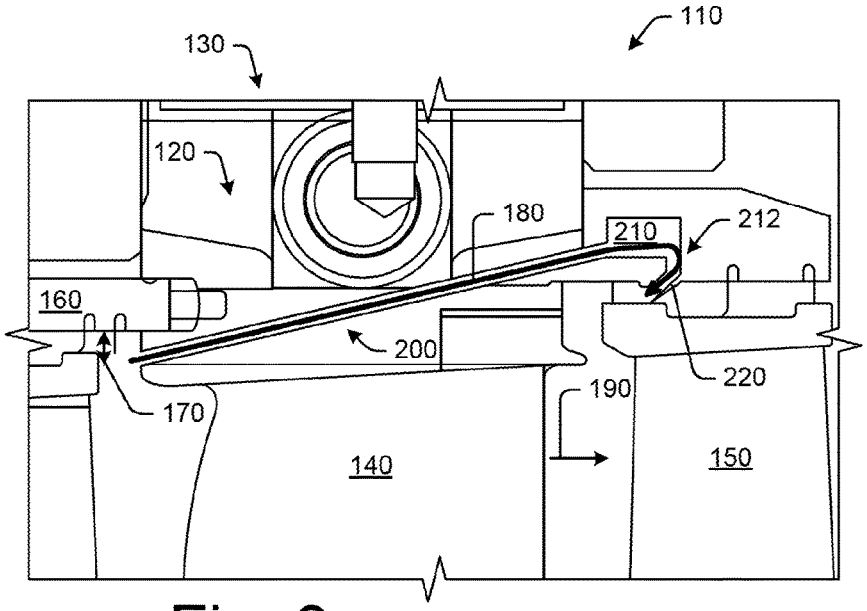

FIG. 3 depicts a schematic diagram of a portion of a steam turbine 100 with a leakage flow control system 110 as may be used herein. The leakage flow control system 110 may be used to limit the leakage flow through one or more components of the steam turbine 100. The leakage flow control system 110 may be used about an outer casing 120, a diaphragm 130, or elsewhere.

The steam turbine 100 may include a number of flow guides 140 and a number of blades or flow runners 150 for different stages of the turbine 100. For example, the illustrated flow runner 150 may be a first stage runner and the illustrated flow guide 140 may be a first stage guide. The flow guide 140 and the flow runner 150 may be coupled to a disc or drum. Any number of stages and/or guides and runners may be included.

One or more, or each, of the flow runners 150 may include a tip, a blade, and a root. The root may be configured to couple the runner to the disc or drum of the turbine 100. The blade may be positioned between the root and the tip. In some embodiments, a tip shroud 152 may be coupled to or otherwise be formed at the tip of the flow runner 150.

The diaphragm 130 may form a partition before pressure stages in the turbine casing 120. The diaphragm 130 may hold nozzles and/or seals between stages. The diaphragm 130 may be a platform diaphragm. An extension ring 160 may be coupled to or otherwise attached to a portion of the diaphragm 130. The extension ring 160 may be positioned adjacent to the tip shroud 152 of the flow runner 150. The extension ring 160 may include a number of sealing fins 162 that extend from the extension ring 160 toward the tip shroud 152.

A gap 170 may be formed between the sealing fins 162 of the extension ring 160 and the tip shroud 152 of the flow runner 150. The gap 170 may be formed so as to create a clearance for movement of the flow runner 150 during operation of the turbine 100. During operation, a leakage flow, such as a tip leakage jet 180, may flow through a portion of the turbine 100. The tip leakage jet 180 may be a portion of a mainstream flow 190. For example, the tip leakage jet 180 may flow through the gap 170 between the sealing fins 162 and/or another portion of the extension ring 160 and the flow runner 150.

The tip leakage jet 180 may cause a reduction in efficiency and/or performance of the turbine 100. The tip leakage jet 180 may flow through the gap 170 and may reenter the mainstream flow 190. However, the tip leakage jet 180 may disrupt the mainstream flow and cause mixing losses between the leakage and mainstream flow. The tip leakage jet 180 may also increase entropy and increase incidence onto a downstream blade row.

The leakage flow control system 110 may reduce or eliminate losses caused by the tip leakage jet 180. In the example of FIG. 3, the leakage flow control system 110 may include one or more tip balance slits 200. The tip balance slit 200 may be formed in the diaphragm 130 or in the outer casing 120. The tip balance slit 200 may be a hole, a slit, or another opening forming a pathway for fluid, such as the tip leakage jet 180, to flow. The tip balance slit 200 may be formed in the diaphragm 130 at a radially outward orientation. For example, as shown in FIG. 3, the tip balance slit 200 may be formed so as to create an inclined pathway for fluid to flow downstream from the gap 180. The tip balance slit 200 may therefore form a downstream path for the tip leakage jet 180. The tip balance slit 200 may be formed, in one example, by machining or otherwise removing a portion of the diaphragm and may form a circumferential or partially circumferential slot about the turbine 100.

The leakage flow control system 110 may include a chamber 210 at an end 212 of the tip balance slit 200. The chamber 210 may be a portion of the tip balance slit 200 or may be in fluid communication with the tip balance slit 200. The chamber 210 may be larger in size and/or diameter than the tip balance slit 200. The leakage flow control system 110 may include a tip balance slit outlet 220 in communication with the chamber and/or the tip balance slit 200 that is configured to reintroduce the tip leakage jet 180 to the mainstream flow 190. The tip balance slit outlet 220 may be angled or oriented at the same angle or orientation, or at a different angle or orientation, than the tip balance slit 200. As shown in FIG. 3, the tip balance slit outlet 220 may be angled against or partially against the mainstream flow 190.

The leakage flow control system 110 with one or more tip balance holes or slits 200 may guide the tip leakage jet 180 about the diaphragm 130 and may put positive work into turbine shrouds and provide a steam blanketing or sealing effect.

Figure 4A:
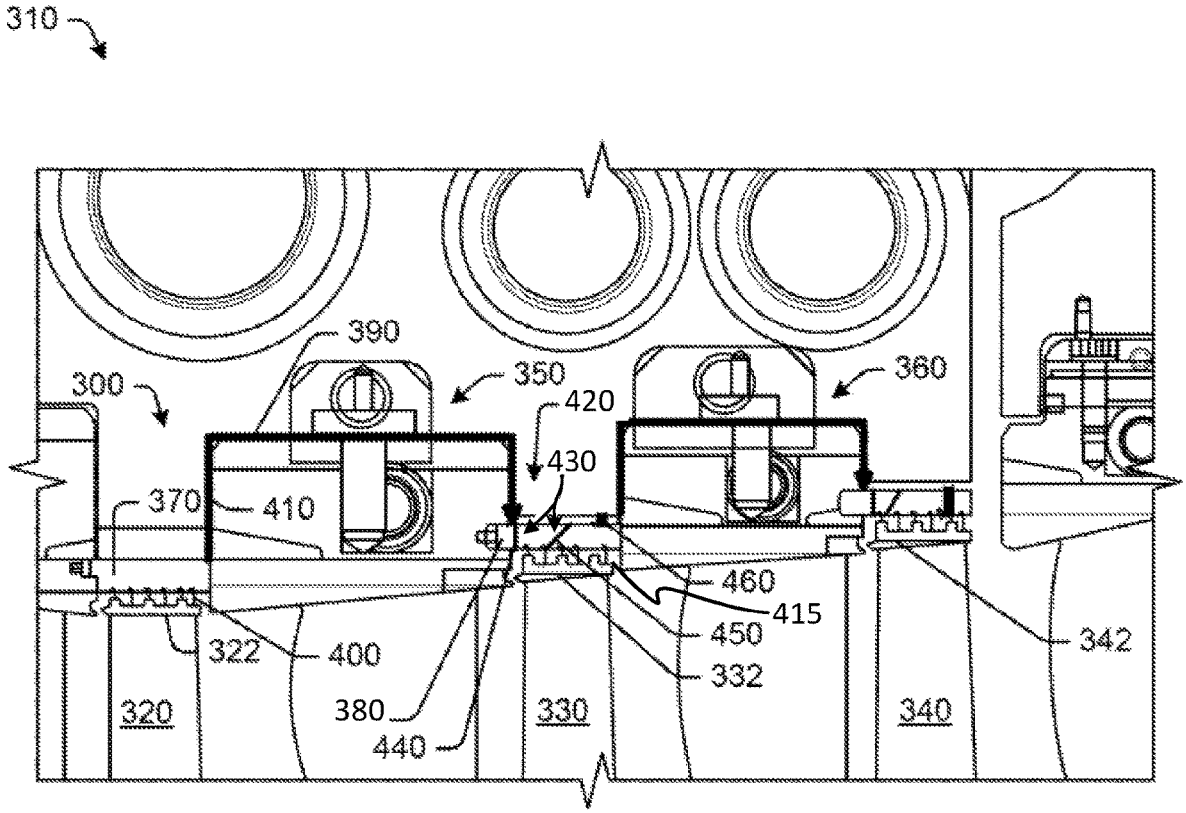
FIGS. 4A-4B are schematic diagrams of a portion of a turbine with a leakage flow control system with a tip balance slit as described herein in accordance with one or more embodiments.
Figure 4B:
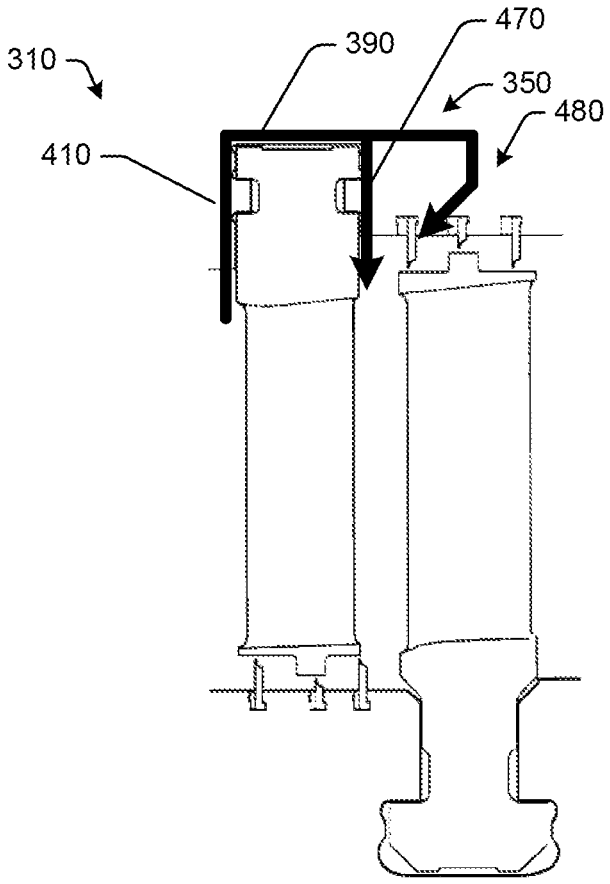

FIGS. 4A-4B illustrate another embodiment of a leakage flow control system 300 as described herein. In FIG. 4, a turbine 310 may include a first flow runner 320 with a first shroud 322, a second flow runner 330 with a second shroud 332, and a third flow runner 340 with a third shroud 342. The turbine 310 may have a reaction technology blading construction. The turbine 310 may include a first diaphragm 350 between the first flow runner 320 and the second flow runner 330, and a second diaphragm 360 between the second flow runner 330 and the third flow runner 340. The second flow runner 330 may correspond to a turbine stage that has a relatively lower pressure than a turbine stage that corresponds to the first flow runner 320. Similarly, the third flow runner 340 may correspond to a turbine stage that has a relatively lower pressure than a turbine stage that corresponds to the second flow runner 330. The second flow runner 330 may be downstream of the first flow runner 320, and the third flow runner 340 may be downstream of the second flow runner 330.

The turbine 310 may include a first extension ring 370 may be coupled to the first diaphragm 350 adjacent to the first tip shroud 322. A second extension ring 380 may be coupled to the second diaphragm 360 adjacent to the second tip shroud 332. A tip leakage jet 390 may flow through a gap 400 between the first extension ring 370 and the first tip shroud 322.

The leakage flow control system 300 may include a flow path 410 through at least a portion of the first diaphragm 350. The flow path 410 may extend around the first diaphragm 350 and may be an opening or gaps between components in the turbine 310. Specifically, the flow path 410 may extend, in one example, from the first flow runner 320 to the second flow runner 330, or to an area adjacent to either or both the first flow runner 320 and the second flow runner 330. The flow path 410 may have a full 360 degree entry.

Some or all of the flow path 410 may be formed by one or more of a crushing peg, a pillar, a slit, or a combination thereof. Crushing pegs and the like may be used to locate diaphragm heads. For example, additional gaps, slits, or holes may be formed in one or more turbine components using the crushing pegs, pillars, etc. A portion of the flow path may be formed along or by gaps on the pressure face 470 of the guide, which may form a first tip balance slit, while in other embodiments, a fluidic seal may be used at the extension ring adjacent the runner to provide an outlet 480 for the tip leakage flow. Some embodiments may use one or the other, or both, of these configurations.

The flow path 410 may be in fluid communication with a space or chamber 420 between the second extension ring 380 and the casing and/or diaphragm. In some embodiments, the second extension ring 380 may be shortened or otherwise modified so as to reintroduce the tip leakage jet 390 into the mainstream flow. In other embodiments, a downstream section of the second extension ring 380 may be located in the casing (e.g., a spring backed gland, etc.) or may be located downstream on the diaphragm. If located downstream on the diaphragm, tip leakage slots may be used to extract the tip leakage flow 390 from the space.

Specifically, the turbine 310 may include a gap 415 between the first diaphragm 350 and the second extension ring 380. At least a portion of the tip leakage jet 390 may flow through the flow path 410 and into the gap 415.

A fluidic seal 460 may be positioned in the gap 415. In some embodiments, the fluidic seal 460 may be positioned at an end of a tip balance slit or at a downstream section of the gap 415 and/or at an outer casing of the turbine. The fluidic seal 460 may be positioned so as to prevent leakage flow from passing behind the extension ring. The fluidic seal 460 may reduce leakage flow losses and may be less prone to certain failures.

The flow path 410 may be used to pass leakage flows across the first diaphragm 350. The tip leakage jet 390 may flow into the flow path 410, around the first diaphragm 350, and into the space between the second extension ring 380 and the diaphragm or casing.

One or more tip balance slits 430 may be formed in the second extension ring 380 to reintroduce the tip leakage jet 390 from the space into the mainstream flow. For example, a first tip balance slit 440 may be downstream of the flow path 410 and may be configured to introduce the tip leakage jet 390 from the flow path 410 to the mainstream flow near the second flow runner 330. In some embodiments, the first tip balance slit 440 may be an angled tip balance slit, while in other embodiments the first tip balance slit 440 may be a straight tip balance slit. Some embodiments may include more than one type of tip balance slit.

The leakage flow control system 400 may include a second tip balance slit, which may be an angled tip balance slit 450 that is positioned adjacent to the first tip balance slit 440. The angled tip balance slit 450 may be formed in the extension ring, and may be configured to reintroduce the tip leakage jet against the mainstream flow. For example, the angled tip balance slit 450 may be angled so as to direct a portion of the the tip leakage flow 390 upstream, or against the mainstream flow. The angled tip balance slit 450 may be downstream of the first tip balance slit 440.

The leakage flow control system 400 may therefore swallow the tip leakage flow, swirl the flow onto the shroud to minimize windage losses, and to provide a steam blanketing effect. A stage efficiency gain may result.

Figure 5:
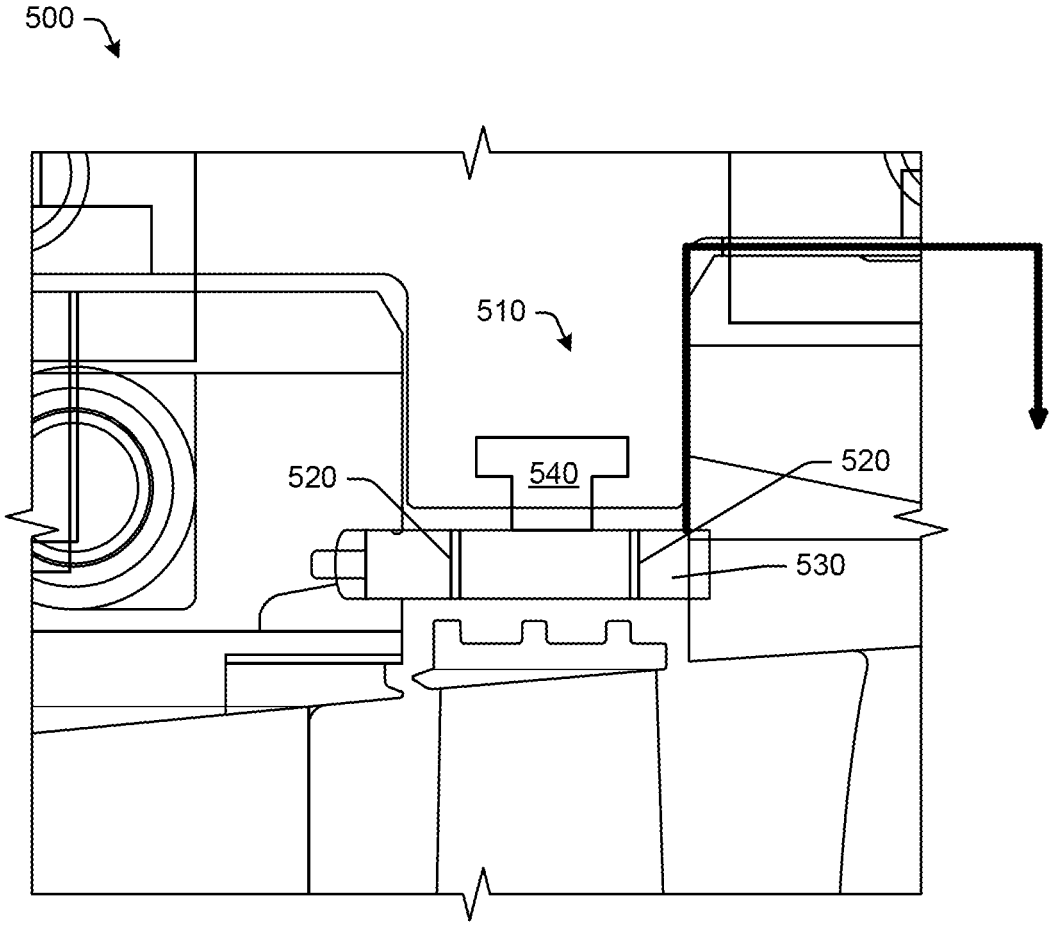
FIG. 5 is a schematic diagram of a portion of a turbine with a leakage flow control system with a tip balance slit as described herein in accordance with one or more embodiments.

In FIG. 5, a portion of a steam turbine 500 is illustrated with a leakage flow control system 510. The leakage flow control system 510 may include one or more angled slots 520 in an extension ring 530. The extension ring 530 may be a shortened and/or simplified extension ring. The sealing feature may be included on upstream and/or downstream diaphragms to restrict interaction with a mainstream flow. A spring backed seal 540 may be positioned in the casing, which may result in slightly increased clearance due to casing distortion, but overall decrease in losses and gain in stage efficiency.

A method of controlling leakage flow in a turbine may include directing a tip leakage jet between a tip shroud and a first extension ring of a turbine, directing the tip leakage jet around a diaphragm, directing the tip leakage jet into a gap between a second extension ring, and directing the tip leakage jet through a tip balance slit formed in the second extension ring.

As a result of the leakage flow control systems described herein, stage efficiency gains for steam turbines may be about 0.50%, with reduced mixing loss and reduced secondary loss/incidence in the following blade row. Certain embodiments may be used to retrofit existing steam turbines. Certain embodiments may include one or more tip balance slits or holes that put positive work into turbine shrouds and may provide a steam blanketing or sealing effect. The leakage flow control systems may therefore improve stage efficiency, while maintaining or improving mechanical reliability and without increasing cost or complexity of the steam turbine. Emissions may be reduced. The tip balance holes may prevent ingestion of mainstream flow, thereby increasing turbine power and/or output. Certain embodiments may be used with impulse and reaction technology blading.

It should be apparent that the foregoing relates only to certain embodiments of this application and resultant patent. Numerous changes and modifications may be made herein by one of ordinary skill in the art without departing from the general spirit and scope of the invention as defined by the following claims and the equivalents thereof.

We claim:

1. A leakage flow control system for a steam turbine, the leakage flow control system comprising:

a flow runner with a tip shroud;

a diaphragm or a flow guide downstream of the flow runner;

an extension ring coupled to the diaphragm or the flow guide and positioned adjacent to the tip shroud;

a tip balance slit that is formed at least partially in the diaphragm or the flow guide, the tip balance slit at least partially defining a leakage flow path;

a tip leakage jet flows through the leakage flow path around the diaphragm or the flow guide;

a gap is defined between the extension ring and the tip shroud, wherein at least a portion of the tip leakage jet flows through the gap and into the leakage flow path; and an angled tip balance slit formed in the extension ring, wherein the angled tip balance slit is configured to reintroduce the tip leakage jet against the mainstream flow.

2. The leakage flow control system of claim 1, further comprising a chamber at an end of the tip balance slit.

3. The leakage flow control system of claim 2, wherein the chamber is positioned at a downstream section of the diaphragm or the flow guide.

4. The leakage flow control system of claim 1, wherein at least a portion of the leakage flow path comprises an opening formed by one or more of a crushing peg, a pillar, a slit, or a combination thereof.

5. The leakage flow control system of claim 1, further comprising a fluidic seal positioned in the gap.

6. The leakage flow control system of claim 1, wherein the tip balance slit defines an outlet configured to reintroduce the tip leakage jet to a mainstream flow at an angle against or partially against the mainstream flow.

7. The leakage flow control system of claim 1, wherein the extension ring comprises a plurality of sealing fins.

8. A steam turbine comprising:

a leakage flow control system comprising:

a first flow runner with a first tip shroud;

a second flow runner with a second tip shroud downstream of the first flow runner;

a diaphragm disposed between the first flow runner and the second flow runner;

a flow path around at least a portion of the diaphragm from the first flow runner to the second flow runner; and a tip balance slit in fluid communication with the flow path, the tip balance slit being configured to introduce a tip leakage jet from the flow path to a mainstream flow near the second flow runner at an angle against or partially against the mainstream flow; and a chamber at an end of the tip balance slit.

9. The steam turbine of claim 8, wherein the tip balance slit defines an outlet configured to reintroduce the tip leakage jet to a mainstream flow at an angle against or partially against the mainstream flow.

10. The steam turbine of claim 8, wherein the chamber is positioned at a downstream section of the diaphragm or a flow guide positioned axially between the first flow runner and the second flow runner.

11. The steam turbine of claim 10, further comprising an extension ring coupled to the diaphragm or the flow guide and positioned adjacent to the first tip shroud.

12. The steam turbine of claim 11, wherein the tip leakage jet flows through the flow path around the diaphragm or the flow guide; and wherein a gap is defined between the extension ring and the first tip shroud, wherein at least a portion of the tip leakage jet flows through the gap and into the flow path.

13. The steam turbine of claim 12, further comprising a fluidic seal positioned in the gap.

14. The steam turbine of claim 12, further comprising an angled tip balance slit formed in the extension ring, wherein the angled tip balance slit is configured to reintroduce the tip leakage jet against the mainstream flow.

15. The steam turbine of claim 12, wherein the extension ring comprises a plurality of sealing fins.

* * * * *